US009297203B2

(12) United States Patent
Hsueh-Cheng

(10) Patent No.: US 9,297,203 B2
(45) Date of Patent: Mar. 29, 2016

(54) CURTAIN DRAWSTRING STRUCTURE

(71) Applicant: Mei-Chin Hsueh-Cheng, Changhua (TW)

(72) Inventor: Mei-Chin Hsueh-Cheng, Changhua (TW)

( * ) Notice: Subject to any disclaimer, the term of this patent is extended or adjusted under 35 U.S.C. 154(b) by 0 days.

(21) Appl. No.: 14/658,125

(22) Filed: Mar. 13, 2015

(65) Prior Publication Data

US 2015/0259976 A1 Sep. 17, 2015

(30) Foreign Application Priority Data

Mar. 13, 2014 (TW) ..... 103204313 U

(51) Int. Cl.
*E06B 9/322* (2006.01)
*E06B 9/326* (2006.01)
*A47H 1/04* (2006.01)

(52) U.S. Cl.
CPC *E06B 9/322* (2013.01); *A47H 1/04* (2013.01); *E06B 9/326* (2013.01); *E06B 2009/3222* (2013.01)

(58) Field of Classification Search
CPC . E06B 9/322; E06B 2009/3222; E06B 9/326; A47H 1/04
USPC ..... 160/170, 84.04, 84.05, 173 R, 178.1 R
See application file for complete search history.

(56) References Cited

U.S. PATENT DOCUMENTS

| | | | | |
|---|---|---|---|---|
| 7,398,815 | B2 * | 7/2008 | Liang | 160/170 |
| 7,487,817 | B2 * | 2/2009 | Liang | 160/170 |
| 2007/0119547 | A1 * | 5/2007 | Liang | 160/170 |
| 2007/0125505 | A1 * | 6/2007 | Liang | 160/170 |
| 2007/0272364 | A1 * | 11/2007 | Liang | 160/84.05 |
| 2007/0284060 | A1 * | 12/2007 | Liang | 160/170 |
| 2008/0093033 | A1 * | 4/2008 | Hsu et al. | 160/169 |
| 2009/0173459 | A1 * | 7/2009 | Hsu et al. | 160/331 |
| 2011/0315329 | A1 * | 12/2011 | Hong et al. | 160/340 |
| 2014/0048499 | A1 * | 2/2014 | Hsu et al. | 211/45 |
| 2014/0069592 | A1 * | 3/2014 | Hsu | 160/84.05 |

* cited by examiner

*Primary Examiner* — Blair M Johnson
(74) *Attorney, Agent, or Firm* — Che-Yang Chen; Law Office of Michael Chen

(57) ABSTRACT

A curtain drawstring structure may include an upper beam, a fixed unit, and a movable unit. The upper beam has a rail groove for a string hole, and a projecting rail is protrudingly disposed at a lower portion of the inner wall of each rail groove, and an evading space is used to separate the two projecting rails. Through the size difference of guiding wheels and steering wheels and the engagement of pressing rods and stepped slots of the fixed unit and movable unit, a retractable cord can be fully separated to avoid entanglement. The retractable cord can be simply wrapped on the guiding wheels and steering wheels to complete the installation process.

5 Claims, 7 Drawing Sheets

CURTAIN DRAWSTRING STRUCTURE

FIELD OF THE INVENTION

The present invention relates to a curtain drawstring structure, and more particularly to a drawstring structure to control opening and closing of the curtain.

BACKGROUND OF THE INVENTION

A conventional curtain has a drawstring to control the movement thereof, and the drawstring is usually disposed at an upper portion of the curtain and droop to the position that the user can handle. When the user pulls the drawstring, the movement of the curtain can be controlled. However, such disposition of the drawstring reduces the aesthetic value of the curtain, and the drawstring may move in an irregular manner with the wind. More importantly, it is unsafe to have the drawstring dangling around because the drawstring is usually at a position that can be reached by little children, and if the little children play with the drawstring, it may end up wrapping around the neck of the children to cause suffocation.

Therefore, there remains a need for a new and improved design for a drawstring structure to overcome the problems presented above.

SUMMARY OF THE INVENTION

The present invention provides a curtain drawstring structure including an upper beam, a fixed unit, and a movable unit. The upper beam has a rail groove for a string hole, and a projecting rail is protrudingly disposed at a lower portion of the inner wall of each rail groove, and an evading space is used to separate the two projecting rails. A retractable cord is disposed at the lower beam extending upwards through the curtain body and the string hole to the upper beam. The retractable cord can be engaged with the fixed unit and the movable unit in the rail groove. The fixed unit has an upper base and a lower base, and the lower base has one bottom plate and two vertical plates at a front end and a rear end respectively. The two vertical plates are provided for the upper base to cross. A lateral passage is formed on the fixed unit through the arrangement of the bottom plate, two vertical plates and the upper base. A guiding wheel and a steering wheel are pivotally disposed on both sides inside the lateral passage, and the diameter of the steering wheel is greater than that of the guiding wheel. A standing rod with a notch is disposed on one side of the lateral passage corresponding to the steering wheel, and the other side thereof has an extending base on the vertical plates. Each of the two extending base has a stepped slot, and a pressing bar is used in the stepped slot. The movable unit has an upper base and a lower base, and the lower base has one bottom plate and two vertical plates at a front end and a rear end respectively. The two vertical plates are provided for the upper base to cross. A lateral passage is formed on the fixed unit through the arrangement of the bottom plate, two vertical plates and the upper base. A guiding wheel and a steering wheel are pivotally disposed on both sides inside the lateral passage, and the diameter of the steering wheel is greater than that of the guiding wheel, and a horizontal edge is extending and formed on the bottom plate of the fixed unit. An extending base is disposed on the vertical plates, and each of the two extending base has a stepped slot, and a pressing bar is used in the stepped slot. A shielding piece is formed on the opposite side of the extending base and the protruding unit is provide for a driving string to insert, so the movable unit can be connected with a string receiving unit (not shown) through the driving string.

Comparing with conventional curtain drawstring structure, the present invention is advantageous because: (i) the curtain can be smoothly operated without a dangling drawstring to increase the aesthetic value of the curtain and avoid dangerousness of neck wrapping; (ii) through the size difference of the guiding wheels and steering wheels, and the engagement of the pressing rods and stepped slots, the retractable cord can be fully separated to avoid entanglement; and (iii) the retractable cord can be simply wrapped on the guiding wheels and steering wheels to complete the installation process.

DETAILED DESCRIPTION OF THE INVENTION

Figure 1:
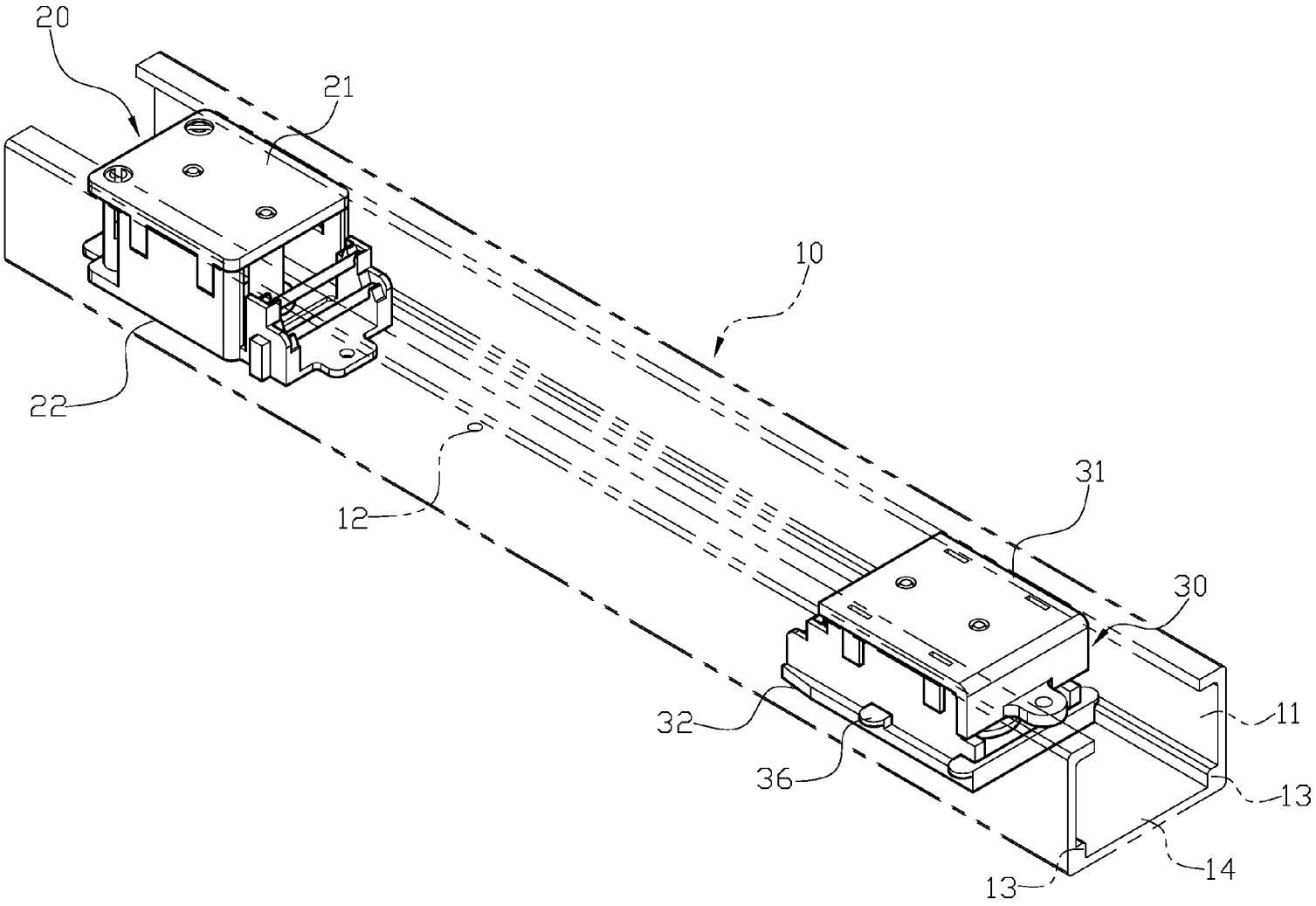
FIG. 1 is a three-dimensional view of the curtain drawstring structure in the present invention.
Figure 2:
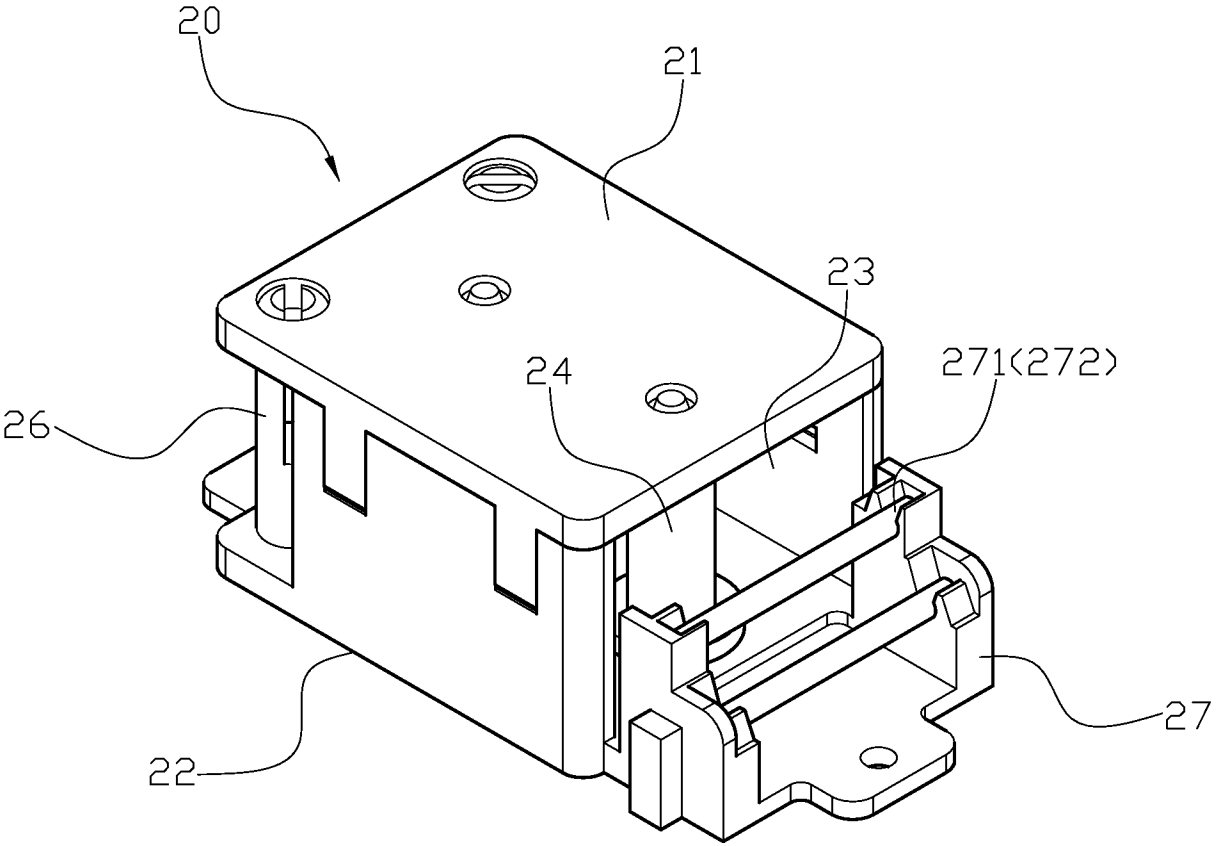
FIG. 2 is a three-dimensional view of the fixed unit in the present invention.
Figure 3:
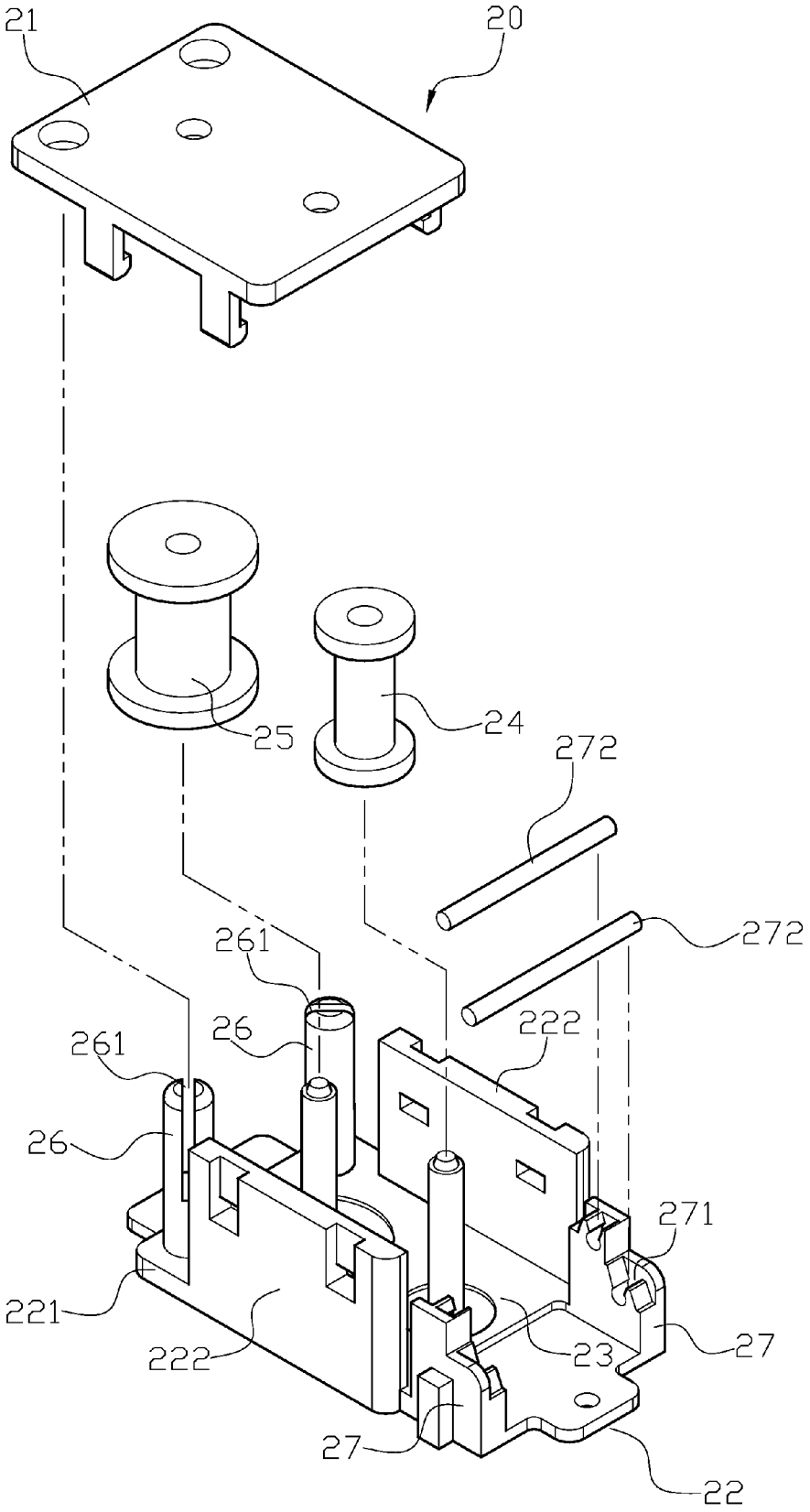
FIG. 3 is an exploded view of the fixed unit in the present invention.
Figure 4:
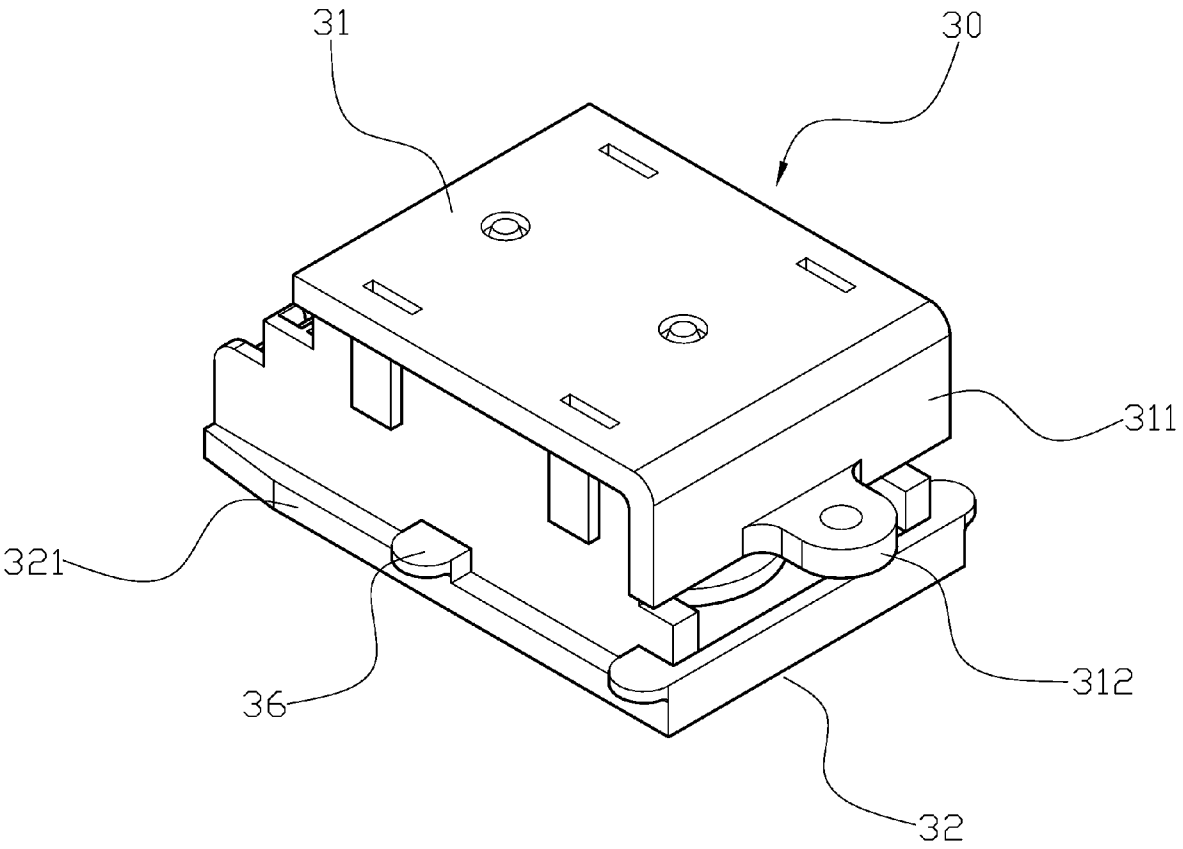
FIG. 4 is a three-dimensional view of the movable unit in the present invention.
Figure 5:
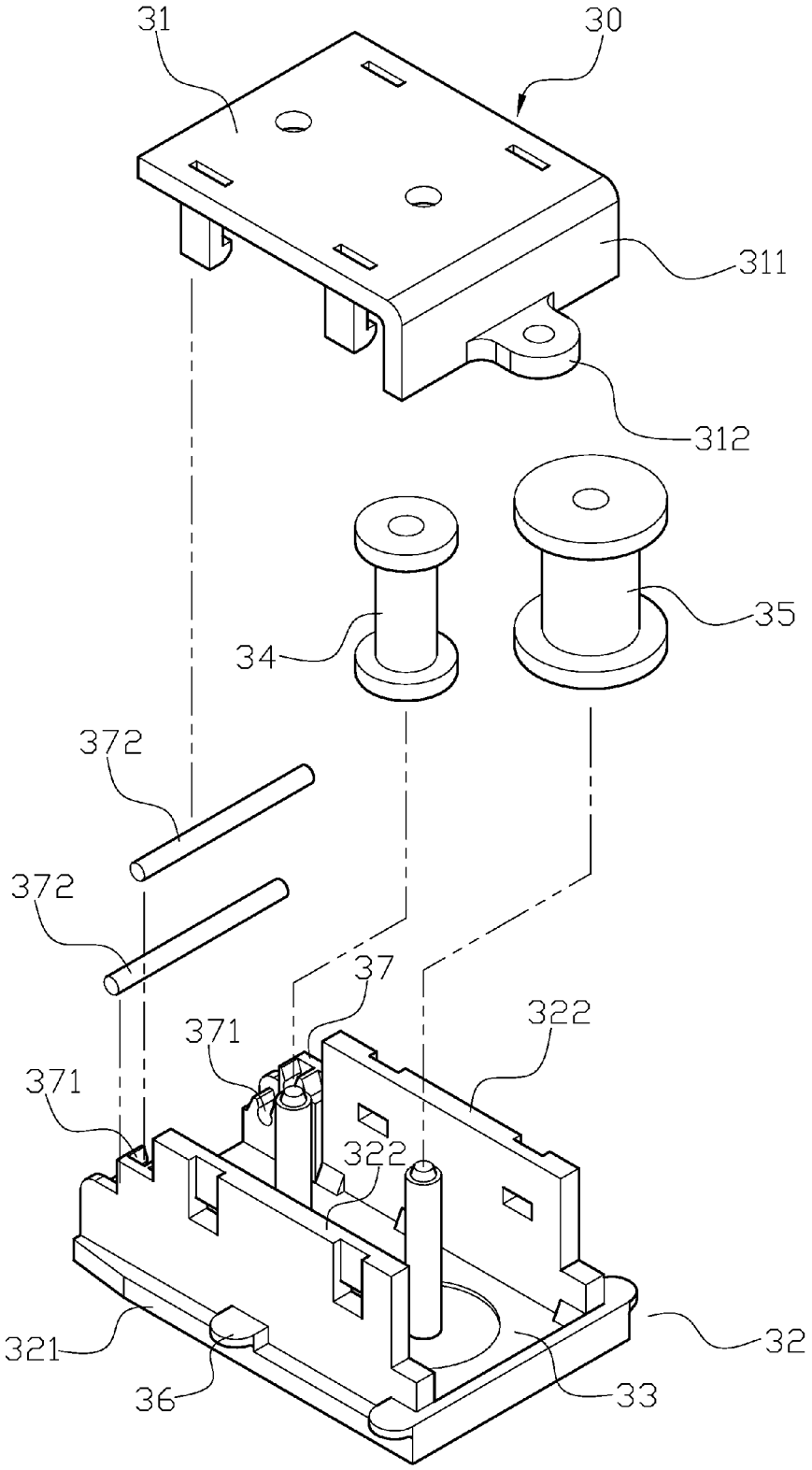
FIG. 5 is an exploded view of the movable unit in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 7, the present invention provides a curtain drawstring structure including an upper beam (10), a fixed unit (20), and a movable unit (30). The upper beam (10) has a rail groove (11) for a string hole (12), and a projecting rail (13) is protrudingly disposed at a lower portion of the inner wall of each rail groove (11), and an evading space (14) is used to separate the two projecting rails (13). A retractable cord (15) is disposed at the lower beam extending upwards through the curtain body and the string hole (12) to the upper beam (10). The retractable cord (15) can be engaged with the fixed unit (20) and the movable unit (30) in the rail groove (11). The fixed unit (20) has an upper base (21) and a lower base (22), and the lower base (22) has one bottom plate (221) and two vertical plates (222) at a front end and a rear end respectively. The two vertical plates (222) are provided for the upper base (21) to cross. A lateral passage (23) is formed on the fixed unit (20) through the arrangement of the bottom plate (221), two vertical plates (222) and the upper base (21). A guiding wheel (24) and a steering wheel (25) are pivotally disposed on both sides inside the lateral passage (23), and the diameter of the steering wheel (25) is greater than that of the guiding wheel (24). A standing rod (26) with a notch (261) is disposed on one side of the lateral passage (23) corresponding to the steering wheel (25), and the other side thereof has an extending base (27) on the vertical plates (222). Each of the two extending base (27) has a stepped slot (271), and a pressing bar (272) is used in the stepped slot (271). The movable unit (30) has an upper base (31) and a lower base (32), and the lower base (32) has one bottom plate (321) and two vertical plates (322) at a front end and a rear end respectively. The two vertical plates (322) are provided for the upper base (31) to cross. A lateral passage (33) is formed on the fixed unit (30) through the arrangement of the bottom plate (321), two vertical plates (322) and the upper base (31). A guiding wheel (34) and a steering wheel (35) are pivotally disposed on both sides inside the lateral passage (33), and the diameter of the steering wheel (35) is greater than that of the guiding wheel (34), and a horizontal edge (36) is extending and formed on the bottom plate (221) of the fixed unit (20). An extending base (37) is disposed on the vertical plates (322), and each of the two extending base (37) has a stepped slot (371), and a pressing bar (372) is used in the stepped slot (371). A shielding piece (311) is formed on the opposite side of the extending base (37) and the protruding unit (312) is provide for a driving string (40) to insert, so the movable unit (30) can be connected with a string receiving unit (not shown) through the driving string (40).

Figure 6:
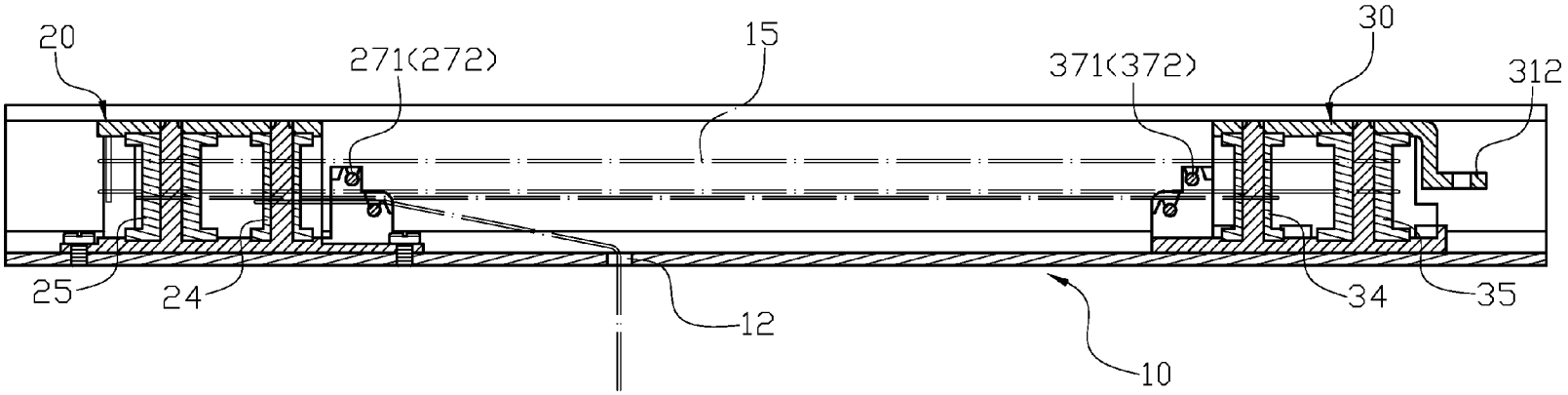
FIG. 6 is a schematic view of the status of restoring/releasing the drawstring.
Figure 7:
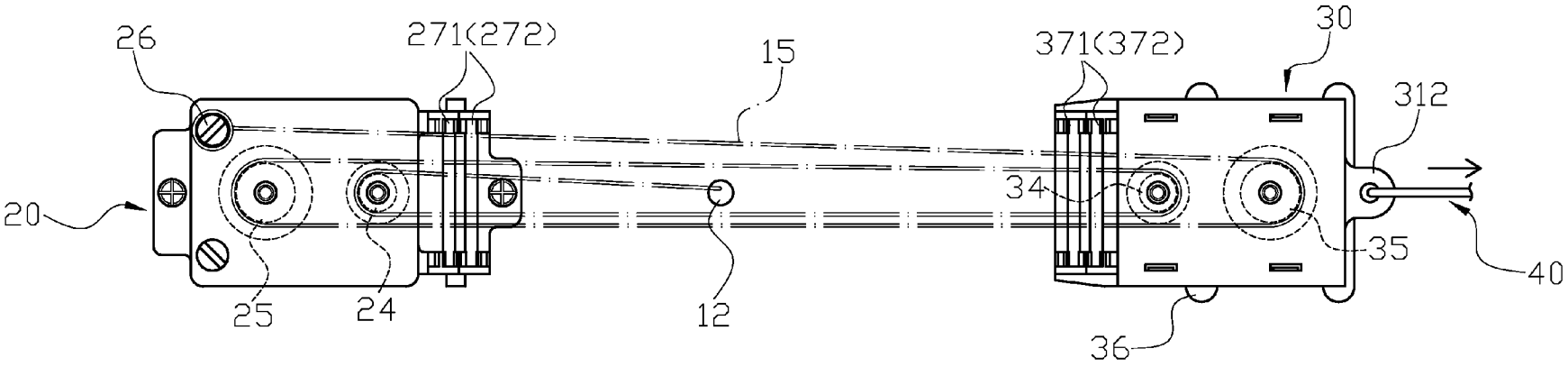
FIG. 7 is a schematic view from another angle of the status of restoring/releasing the drawstring.

Referring to FIGS. 1, 6 and 7, the fixed unit (20) and the movable unit (30) are disposed into the rail slot (11) of the upper beam (10) when the guiding wheels (24)(34) are facing each other, so the fixing unit (20) can be secured at the upper beam (10) on the side opposite to the string receiving unit. The projecting rail (13) is provided for the movable unit (30) to cross through the horizontal edge (36) across the group, and the evading space (14) is provided for the bottom plate (321) to extend therein, so the movable unit (30) can be driven to move to left or right side in the rail slot (11) by the driving string (40) or the curtain body when being pulled down. The retractable cord (15) in the rail slot (11) orderly passes the guiding wheel (24) of fixing unit (20), the guiding wheel (34) of movable unit (30), the steering wheel (25) of the fixing unit (20) and the steering wheel (35) of the movable unit (30), and at the end is secured at the notch (261) of the standing rod (26) of the fixed unit (20). Because of the size difference between the guiding wheels (24)(34) and steering wheels (25)(35), the pressing bars (272)(372) are inserted into the stepped slots (271)(371) in order to separate the retractable cord (15) in a manner of a higher position and a lower position to avoid entanglement of the retractable cord (15).

When in use, people can pull down the curtain body and meanwhile the movable unit (30) is moving towards the fixed unit (20) through the retractable cord (15), and the driving string (40) can be simultaneously pulled outward by the movable unit (30), so that the curtain body can be smoothly lowered. Through the weight of the curtain body and the lower beam, the force of the string receiving unit can be overcome and the curtain can be precisely positioned at any height. When the curtain body is lifted up, the driving string (40) can be automatically wrapped on the string receiving unit and simultaneously pull back the movable unit (30). It can make the movable member (30) pull back. Thus, the curtain can be operated but it is unnecessary to have a drawstring dangling on one side of the curtain to avoid the dangerousness of wrapping the drawstring on the children's neck.

In one embodiment, the engagement of the upper bases (21)(31) and lower bases (22)(32) is through hooks.

Comparing with conventional curtain drawstring structure, the present invention is advantageous because: (i) the curtain can be smoothly operated without a dangling drawstring to increase the aesthetic value of the curtain and avoid dangerousness of neck wrapping; (ii) through the size difference of the guiding wheels (24)(34) and steering wheels (25)(35), and the engagement of the pressing rods (272)(372) and stepped slots (271)(371), the retractable cord (15) can be fully separated to avoid entanglement; and (iii) the retractable cord (15) can be simply wrapped on the guiding wheels (24)(34) and steering wheels (25)(35) to complete the installation process.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A curtain drawstring structure comprising:

an upper beam having a rail groove with a string hole and two inner walls on both sides of the rail groove, two projecting rails protrudingly formed at a lower portion of the two inner walls of said rail groove, and an evading space used to separate the two projecting rails, a retractable cord extending upwards through a curtain body and the string hole on the upper beam;

a fixed unit having a first upper base and a first lower base, said first lower base having a first bottom plate and two first vertical plates at a front end and a rear end respectively, wherein the two first vertical plates are provided for the first upper base to cross, and a lateral passage is formed on the fixed unit through the arrangement of the first bottom plate, two first vertical plates and the first upper base, wherein a guiding wheel and a steering wheel are pivotally disposed inside the lateral passage, and the diameter of the steering wheel is greater than that of the guiding wheel, and a standing rod with a notch is disposed on one side of the lateral passage corresponding to the steering wheel, and the other side thereof has a first extending base on each of the first vertical plates, wherein each of the first extending bases has a first stepped slot, and a first pressing bar is used in the first stepped slot; and a movable unit having a second upper base and a second lower base, the second lower base having a second bottom plate and two second vertical plates at a front end and a rear end respectively, wherein the two second vertical plates are provided for the second upper base to cross, and a lateral passage is formed on the movable unit through the arrangement of the second bottom plate, two second vertical plates and the second upper base, wherein a guiding wheel and a steering wheel are pivotally disposed on both sides inside the lateral passage, and the diameter of the steering wheel is greater than that of the guiding wheel, and a horizontal edge is extending and formed on the second bottom plate of the movable unit, wherein a second extending base is disposed on each of the second vertical plates, and each of the second extending bases has a second stepped slot, and a second pressing bar is used in the second stepped slot, wherein a shielding piece is formed on the opposite side of the second extending base to secure a driving string, so the movable unit is connected with a string receiving unit through the driving string.

2. The curtain drawstring structure of claim 1, wherein the engagement of the first upper base and the first lower base of the fixed unit is through first hooks.

3. The curtain drawstring structure of claim 1, wherein the engagement of the second upper base and the second lower base of the movable unit is through second hooks.

4. The curtain drawstring structure of claim 1, wherein the shielding piece has a protruding unit to secure a driving string.

5. The curtain drawstring structure of claim 1, wherein the retractable cord is engaged with the fixed unit and the movable unit in the rail groove.

* * * * *